United States Patent [19]

Altizer

[11] Patent Number: 4,674,250

[45] Date of Patent: Jun. 23, 1987

[54] MODULAR BUILDING PANEL

[76] Inventor: Wayne Altizer, 101 Wakefield Rd., Apartment #A, Oak Ridge, Tenn. 37830

[21] Appl. No.: 639,840

[22] Filed: Aug. 13, 1984

[51] Int. Cl.[4] ..... E04C 2/02; E05F 11/53; E05F 11/54

[52] U.S. Cl. ..... 52/309.7; 49/372; 52/210

[58] Field of Search ..... 52/309.1, 309.4, 309.12, 52/309.6, 309.7, 601, 202, 210; 49/372

[56] References Cited

U.S. PATENT DOCUMENTS

| | | | |
|---|---|---|---|
| 3,736,715 | 6/1973 | Krumwiede | 52/601 |
| 4,147,004 | 4/1979 | Day et al. | 52/309.9 |
| 4,185,437 | 1/1980 | Robinson | 52/601 |
| 4,236,361 | 12/1980 | Boden | 52/204 |
| 4,314,430 | 2/1982 | Farrington | 52/309.12 |
| 4,385,470 | 5/1983 | Bryson et al. | 49/372 |
| 4,409,768 | 10/1983 | Boden | 52/309.4 |
| 4,467,859 | 8/1984 | Carroll et al. | 52/309.7 |

*Primary Examiner*—Billy S. Taylor
*Attorney, Agent, or Firm*—Pitts & Brittian

[57] ABSTRACT

An improved modular building (10) is disclosed, the building (10) comprising sidewall modules (11), and ceiling modules (12). The sidewall modules (11) comprise a primary frame (19) to which a secondary frame of furring strips (26) is attached. The sidewall modules (11) further comprise foam insulation (27) molded around the primary and secondary frame to define exterior and interior planar surfaces (28, 29). The ceiling modules (12) comprises frame means supporting a plurality of ceiling joists (67), and foam insulation (27) dispersed within the frame means and between the ceiling joist (67) so as to define upper and lower ceiling surfaces (68, 69). In one embodiment, floor modules (14) are also provided. A method for fabricating the various modules of the present invention is also disclosed.

7 Claims, 18 Drawing Figures

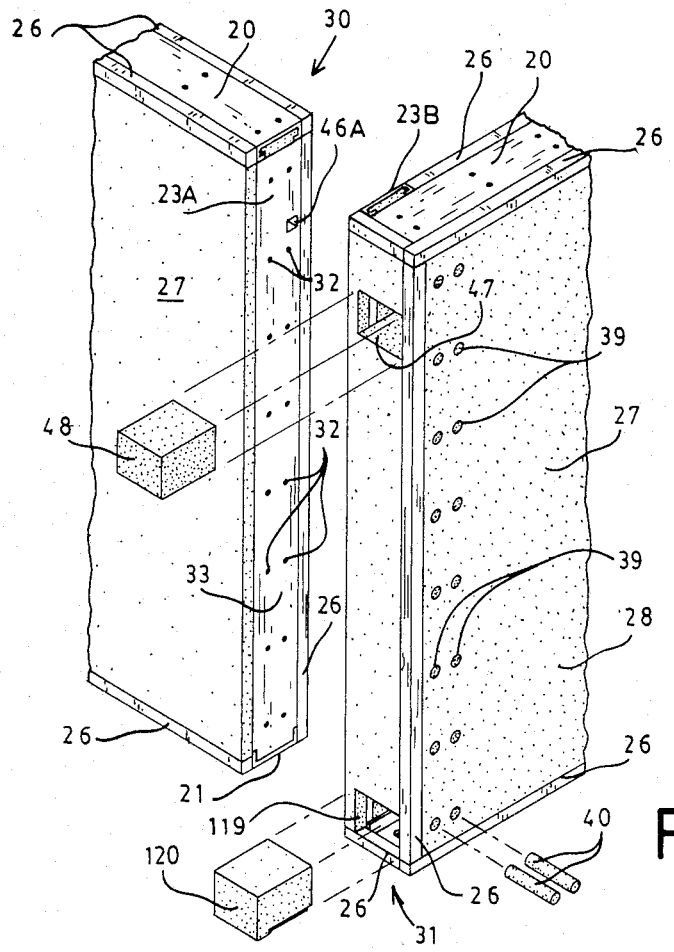
FIG. 3
FIG. 4A
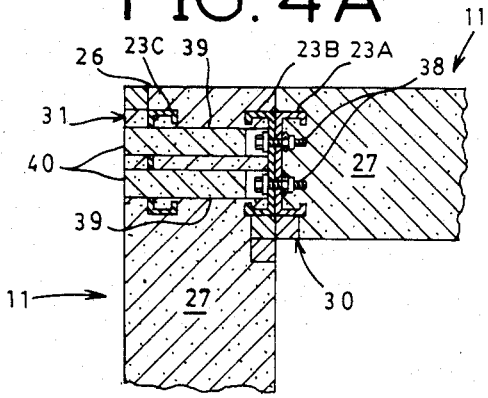
FIG. 4B
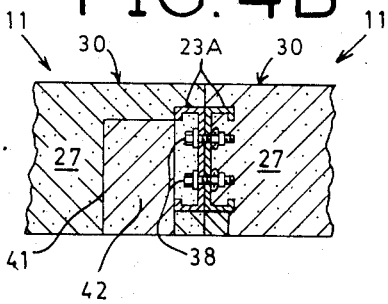

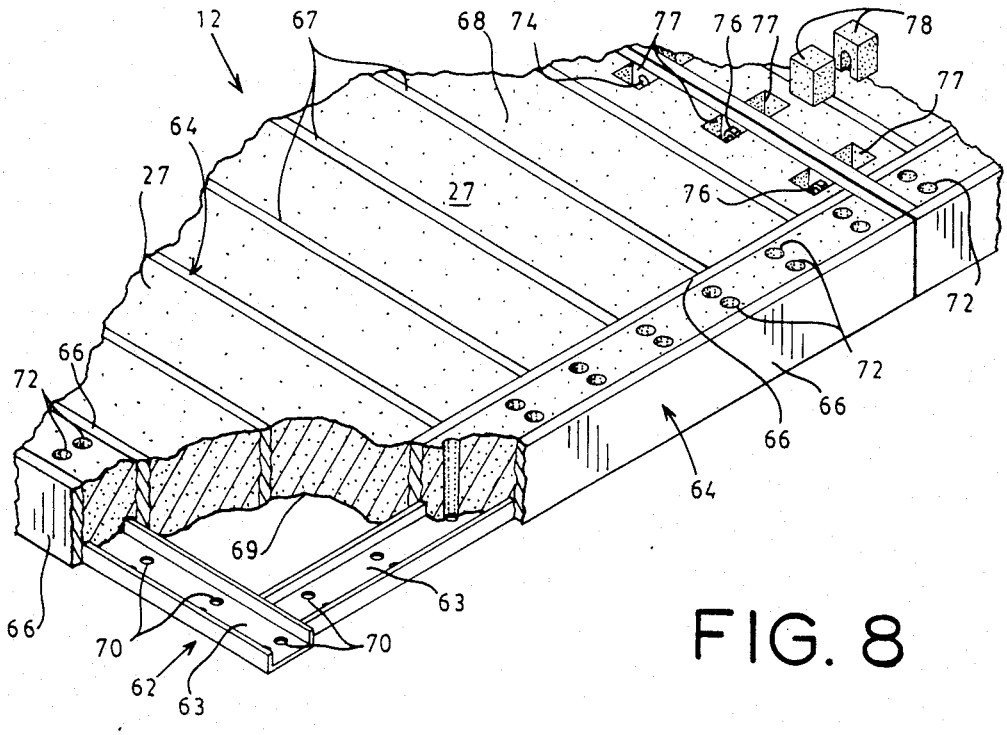
FIG. 8
FIG. 9
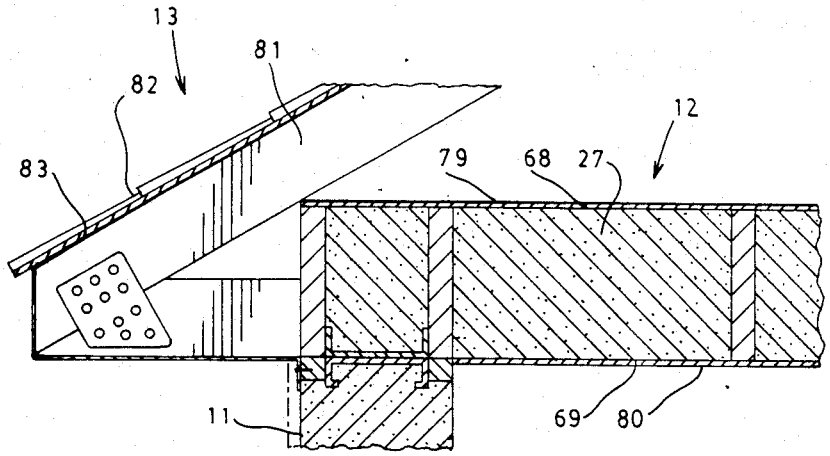

MODULAR BUILDING PANEL

DESCRIPTION

1. Technical Field

This invention relates to an improved modular building comprising sidewall modules, floor modules and ceiling modules for being prefabricated at a fabricating facility and transported to the building site for assembly. The invention further relates to an injection mold process for fabricating the various improved modules.

2. Background Art

Various modular building concepts have been explored in an attempt to reduce the time and labor required to construct buildings, and, thus, to reduce the costs associated with such construction. However, most of these attempts have simply been attempts to prefabricate building components at fabricating facilities using conventional construction methods, contemplating transporting the components to the construction site for assembly. Whereas on site construction time may be reduced by such methods, conventionally constructed components are susceptible to damage upon transporting and, at best, the end result is a conventionally constructed structure with no improvements to energy efficiency.

Certain attempts have been made to produce prefabricated components which are structurally sound enough for transporting and which produce increase energy efficiency in the resulting structure. One example is the prefabricated wall panel disclosed in U.S. Pat. No. 4,409,768, issued to J. Boden on Oct. 18, 1983. However, the Boden patent does not provide for the mounting of conventional windows and doors or provide other features which allow the incorporation of the panels into usable energy efficient buildings. Other attempts at prefabricated construction are disclosed in U.S. Pat. Nos. 4,426,818; 4,426,060; 4,236,361; 4,138,833; 3,315,424; and 3,310,917.

Accordingly, it is an object of the present invention to provide an improved modular building which comprises components which can readily be fabricated in a fabricating facility and transported to a building site for assembly.

It is another object of the present invention to provide an energy efficient modular building requiring little on site labor.

Yet another object of the present invention is to provide an improved modular building constructed of components which are inexpensive to manufacture.

Still another object of the present invention is to provide a method for fabricating improved modular building components for constructing an energy efficient building.

DISCLOSURE OF THE INVENTION

Other objects and advantages will be accomplished by the present invention which provides an improving modular building and associated fabricating method. The building of the present invention comprises sidewall modules, ceiling modules, and in one preferred embodiment, floor modules, which are fabricated at a fabricating facility and transported to the building site for assembly. The sidewall modules comprise a primary frame and a secondary frame of furring strips secured to the primary frame, the furring strips providing anchoring structures for exterior siding, interior paneling, windows, etc. The primary and secondary frames of the sidewall modules are filled with rigid foam insulation with appropriate voids being left free of insulation for receiving windows and doors. Recesses are provided proximate window and door openings for slidably mounting insulation panels for insulating such openings and the sidewall modules are provided with opposite end portions provided with means for engaging an adjacent sidewall panel.

The ceiling modules comprise a primary frame and a secondary frame secured to the primary frame, the secondary frame carrying a plurality of ceiling joists. The ceiling modules are filled with rigid foam insulation and are provided with means for engaging the sidewall modules and means for engaging adjacent ceiling modules. Similarly, the floor modules comprise a perimeter frame supporting a plurality of selectively spaced substantially parallel floor joists, and are at least partially filled with rigid foam insulation. Further, the floor modules are provided with means for engaging the sidewall modules, and adjacent floor modules as well as means for engaging a suitable foundation.

The fabricating method by which the various modules are fabricated generally comprises the assembly of the associated module frame, and placement of the frame in an injection mold whereupon foam insulation is injected filling the frame and forming the insulation filled modules.

BRIEF DESCRIPTION OF THE DRAWINGS

The above-mentioned features of the invention will become more clearly understood from the following detailed description of the invention read together with the drawings in which:

FIG. 3 illustrates a perspective view of the engaging ends of the sidewall modules of the present invention.

FIGS. 4A and 4B illustrate top views, in section, of the engaging ends of the sidewall modules of the present invention.

FIG. 8 is a perspective view, partially in section, of a portion of a ceiling module of the present invention.

FIG. 9 is a side elevation view, in section, of a portion of the roof of the building of the present invention.

BEST MODE FOR CARRYING OUT THE INVENTION

Figure 1:
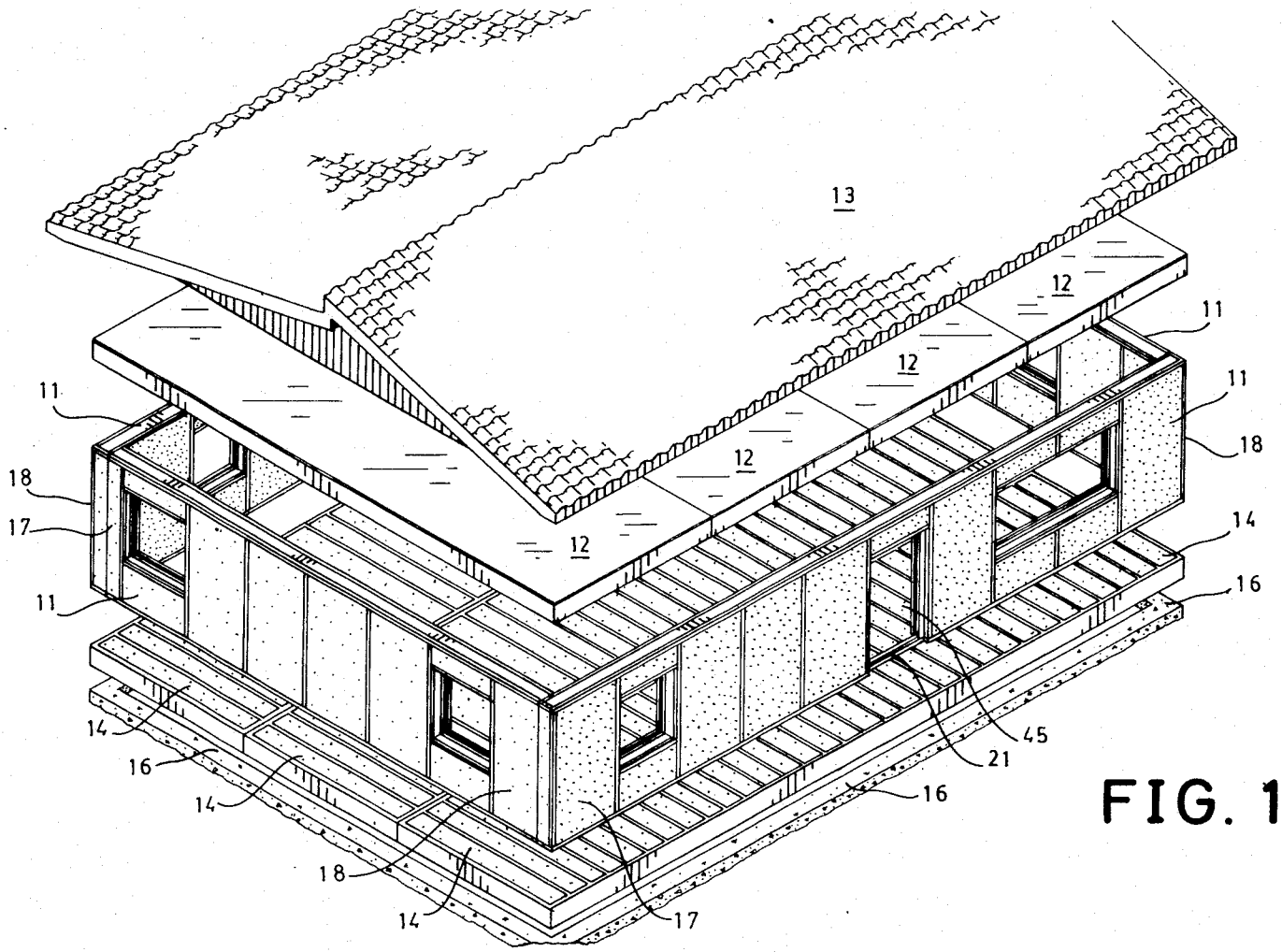
FIG. 1 illustrates a perspective view of the improved building of the present invention.

A modular building incorporating various features of the present invention is illustrated at 10 in FIG. 1. Generally the building 10 comprises sidewall modules 11, ceiling modules 12, and a roof 13. Further, in the preferred embodiment of FIG. 1, the building 10 comprises floor modules 14 for being supported by a conventional foundation 16. However, as will be discussed further below, where a concrete slab is used as a foundation, the floor modules 14 are not necessary and the sidewall modules 11 can be secured directly to, and supported by, the concrete slab. The building 10 is designed such that the sidewall modules 11, the ceiling modules 12 and the floor modules 14 are fabricated at a fabrication facility and transported to the building site where they are assembled into the building 10. Accordingly, on site construction time is reduced to a minimum.

As illustrated in FIG. 1, the sidewall modules 11 can be fabricated such that one such module 11 constitutes a side of the bulding 10, with four such sidewall modules 11 being joined at their opposite ends 17 and 18 to complete the exterior walls of the building 10. However, it is desirable that the modules 11 be no more than forty (40') feet in length such that they can be transported by a conventional tractor and trailer. Therefore, if a large building is desired, two or more sidewall modules 11 can be joined end-to-end to construct a side of the building.

Figure 2:
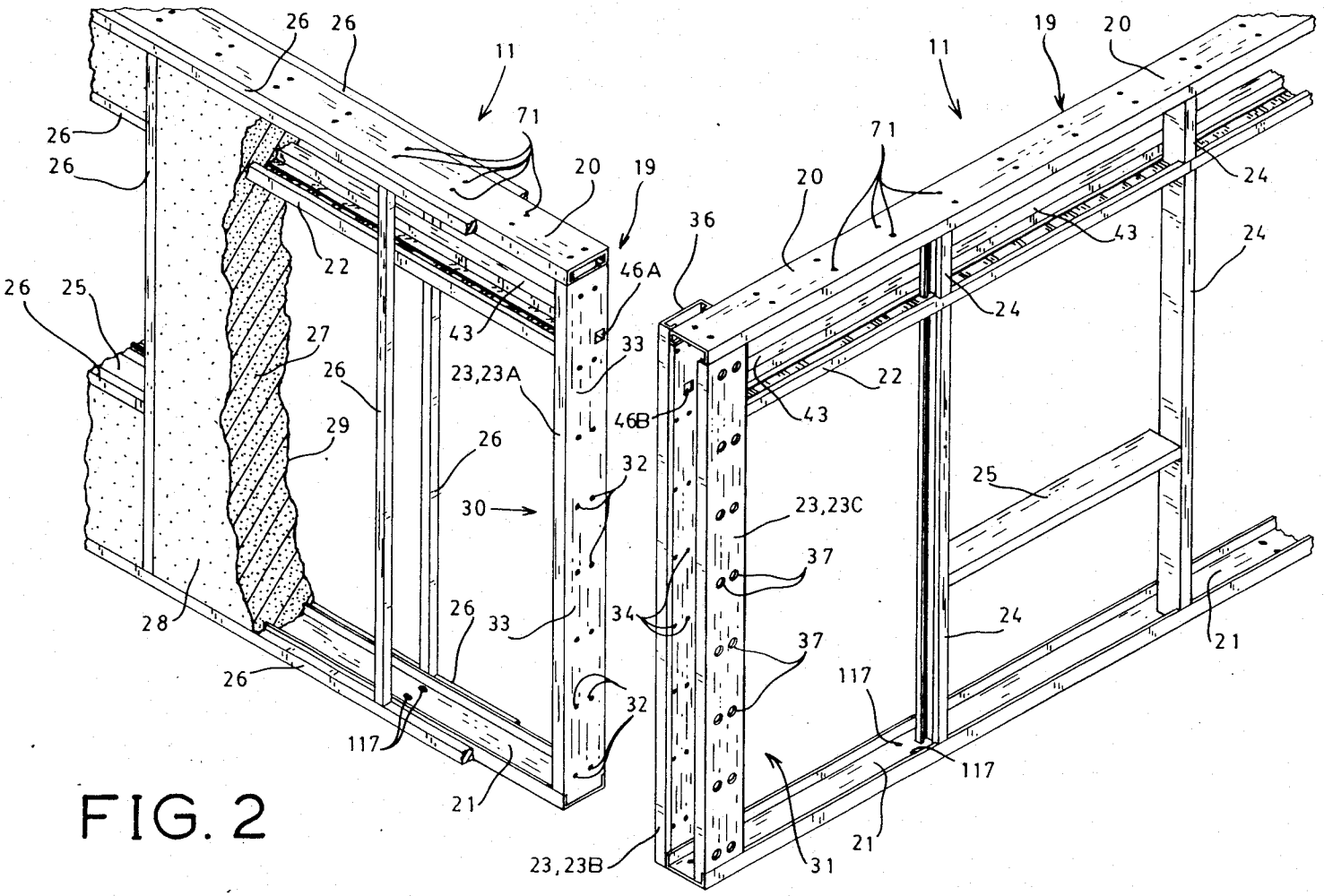
FIG. 2 illustrates a perspective view, partially in section, of sidewall modules of the present invention.

Referring now to FIG. 2, in the preferred embodiment, each of the sidewall modules 11 comprises a primary frame 19 which includes upper and lower horizontal supports 20 and 21, respectively, which extend the length of the sidewall module 11 and futher includes a lintel beam 22 which extends substantially the length of the modules 11. One or more vertical supports 23 are provided at each opposite end 17 and 18 of the module 11, the vertical supports 23 being secured at their upper end portions to upper support 20 and at their lower end portions to lower support 21. Further, as illustrated, the lintel beam 22 is secured at its opposite ends to the vertical supports 23. Various selectively spaced vertical braces 24 are also provided to further strengthen the frame 19, to define door openings, and, together with the sill braces 25, to define window openings, all of which will be discussed further below.

The frame 19 is preferrably fabricated of steel, aluminum, or other durable metal. More specifically, a steel or aluminum girder having a U-shaped cross-section is suitable for use as the lower support 21 and a steel or aluminum girder having a C-shaped cross-section, commonly known as a C-section, is suitable for use as the upper supports 20, the vertical supports 23 and the various vertical braces 24. It will be appreciated that various conventional fastening methods such as welding, riveting, etc., can be used to secure the various components or the frame 19 together. For example, the FAB-LOCK fasteners discussed below are suitable for this purpose.

The sidewall modules 11 further include an exterior and interior secondary frame comprising furring strips 26. More specifically, the furring strips 26 are secured to the exterior and interior facing edges of the upper and lower supports 20 and 21 and, as will be discussed further below, are secured around those portions of the frame 19 which define window and door openings. Further, vertically oriented furring strips 26 are provided at selected intervals along the length of the sidewall modules 11. It will be appreciated that the furring strips 26 are preferrably fabricated of wood and can be secured to the frame 19 with screws, bolts or other suitable fasteners. It will also be appreciated by those skilled in the art that the furring strips 26 serve as anchoring structures for securing exterior siding and interior drywall or paneling, and for mounting windows and doors. Accordingly, the the location of the furring strips can vary depending on type and location of windows and doors incorporated into the building 10, and depending on the type of interior and exterior wall covering applied to the modules 11, the number of furring strips necessary may vary. In this regard, for example, where a brick or stucco exterior is used, it is not necessary to provide vertically oriented furring strips 26 at invervals as would be necessary for anchoring exterior siding.

The frame 19 and the exterior and interior secondary frame of furring strips 26 are filled with foam insulation 27 in accordance with the method disclosed below, with the foam insulation 27 defining exterior and interior planar surfaces 28 and 29, respectively, which are flush with the outer facing surfaces of the furring strips 26. Desirably the foam insulation 27 comprises a rigid polystyrene, polyurethane, or polyisocyanurate foam or styrofoam. It will be appreciated by those skilled in the art that such foam insulation offers a high R-value and tends to maintain this high R-value over long periods of time.

As indicated above, the sidewall modules 11 are joined at their opposite ends 17 and 18 to create the sidewalls of the building 10, and accordingly, the modules 11 are provided with means for engaging adjacent sidewall modules. In one preferred embodiment, as illustrated in FIGS. 2 and 3, in order to facilitate joining adjacent sidewall modules 11 to make a ninety degree corner, one sidewall module 11 is provided with a first engaging end 30 and the adjacent module 11 is provided with a second cooperating engaging end 31. The first engaging end 30 comprises a vertical support 23A provided with a plurality of selectively spaced holes 32. The vertical support 23A of the first engaging end 30 is oriented so as to provide an engaging surface 33 which is perpendicular to the exterior and interior planar surfaces 28 and 29. The second cooperating engaging end 31 comprises a vertical support 23B provided with holes 34 registering with the holes 32 of the vertical support 23A and oriented so as to provide an engaging surface 36 for engaging the surface 33 of the first engaging end 30. To ensure that the engaging end 31 is properly supported a futher vertical support 23C is provided, the vertical support 23C, having a plurality holes 37 registering with the holes 32 and 34.

As illustrated in FIG. 4A, the vertical supports 23A and 23B are secured together with fasteners 38 which are received through the holes 34 and 32 and locked in place. Of course, a suitable gasket (not shown) in secured between the engaging surfaces 33 and 36 to properly seal the junction of the two modules 11. In order to provide access such that the fasteners 38 can be placed in position, access conduits 39 are provided which register with the holes 37 and 34. As illustrated in FIGS. 3 and 4A, after the fasteners 38 have been locked in place, the conduits 39 are sealed with the foam insulation plugs 40 in order to maintain the continuity of the insulation of the sidewall modules 11. It will be appreciated that the fasteners 38 are preferrably of a type which can be locked into place without requiring manipulation from both sides of the structures to be secured, such that the conduits 39 provide sufficient access to allow installation. An example of a suitable fastener would be the FAB-LOK fastener manufactured by Townsend Division of Textron, Inc., and disclosed in U.S. Pat. No. 3,667,340.

Where sidewall modules 11 are being joined to form a common sidewall, it will be appreciated that the engaging ends of the modules 11 are essentially the configuration of the engaging end 30 as is illustrated in FIG. 4B, and are similarly secured with fasteners 38. However, when side modules 11 are being joined end-to-end, one of the modules 11 is provided with access voids 41 proximate the locations at which the fasteners 38 are secured such that the fasteners 38 can be inserted. The voids 41 are filled with foam insulation plugs 42 subsequent to the fasteners 38 being secured, once again, to ensure the continuity of the insulation 27.

Figure 5:
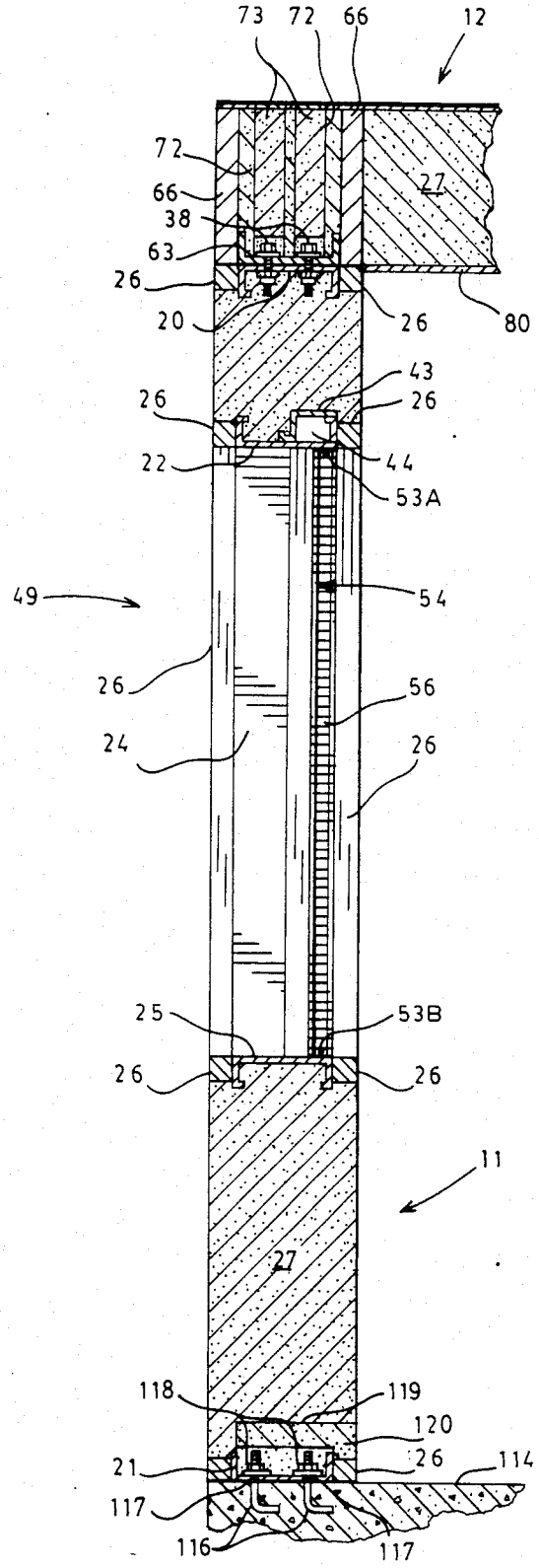
FIG. 5 is a side elevation view, in section, of a sidewall module of the present invention as it engages a concrete slab foundation and a ceiling module of the present invention.

As is illustrated in FIG. 5, a cover member 43 is secured to, and extends the length of, the lintel beam 22 so as to define an electrical wiring passageway 44 which extends the length of the sidewall modules 11. The passageway 44 provides a passageway for running electrical wiring throughout the building 10. As will be noted in FIG. 2, openings 46A and 46B are provided in the vertical supports 23A and 23B, respectively, which communicate with the passageway 44 such that wiring may be run from one sidewall module 11 to another. Further, as illustrated in FIG. 3, a void 47 is provided in the insulation 27 to provide access to the wiring passageway 44, the void 47 being filled with the plug 48 when wiring has been installed. It will be appreciated that holes (not shown) will be provided at selected intervals along the passageway 44 such that wiring can exit the passageway 44 to communicate with electrical fixtures (not shown).

Figure 6:
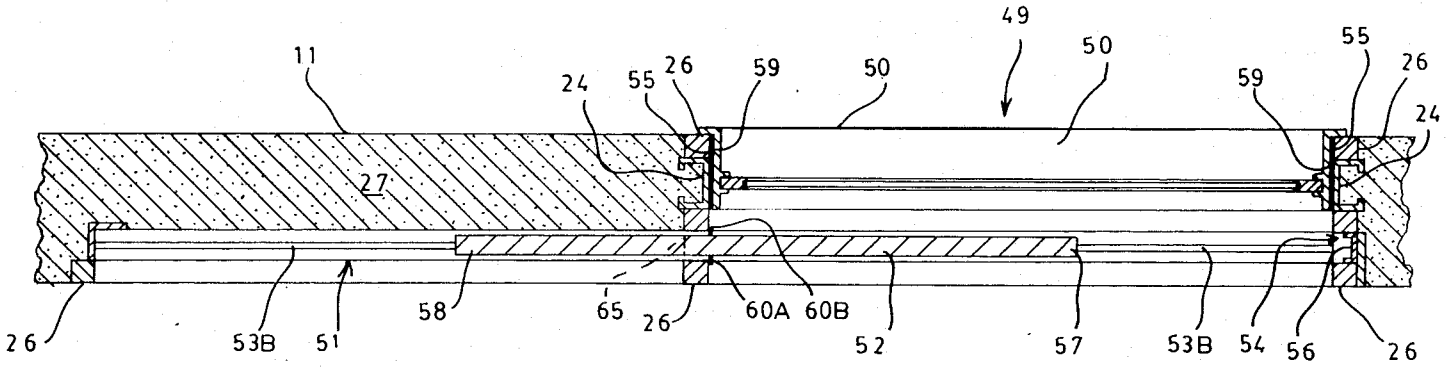

Referring now to FIGS. 5 and 6, a sidewall module 11 provided with window opening 49 is depicted. As illustrated, the window opening 49 is defined by the lintel beam 22, vertical braces 24 and sill brace 25, each being faced with furring strips 26. Accordingly, a window unit 50 is received in the window opening 49 and secured to the furring strips 26 with suitable fasteners such as screws (not shown). As will be noted by those skilled in the art, the window unit 50 is unlike a conventional window unit in that it is provided with a perimeter engaging surface 55 which is planar rather than profiled to be received in a window opening as is the case with a conventional window unit. In this regard, the planar engaging surface 55 lined with the perimeter gasket 59 ensures a moisture impurvious seal between the window unit 50 and the opening 49 given the construction of the opening 49. However, it will be appreciated that with minor modifications, a conventional window unit can be mounted in the opening 49.

As is best illustrated in FIG. 6, a recess 51 is provided in the foam insulation 27 of the sidewall module 11 adjacent the window opening 49 for slidably receiving window insulation panel 52. The insulation panel 52 is sidably mounted on upper and lower tracks 53A and 53B, respectively. Accordingly, the insulation panel 52 can be slidably moved to cover and insulate the window opening 49 or can be slidably retracted into the recess 51 when not in use. A vertical recess 54 carrying a gasket 56 is provided to receive forward edge 57 of the panel 52 to ensure that the forward edge 57 is properly sealed when in insulating position. Further, when the panel 52 is in place in the window opening 49, the rearward edge 58 of the panel 52 extends into the recess 51 as shown by phantom line 65, and the oppositely disposed gaskets 60A and 60B serve to seal the rearward edge 58. It will be appreciated that when the panel 52 is in insulating position, it seals the window opening 49 so as to stop heat loss, or gain, through the glass surface of the window.

Figure 7:
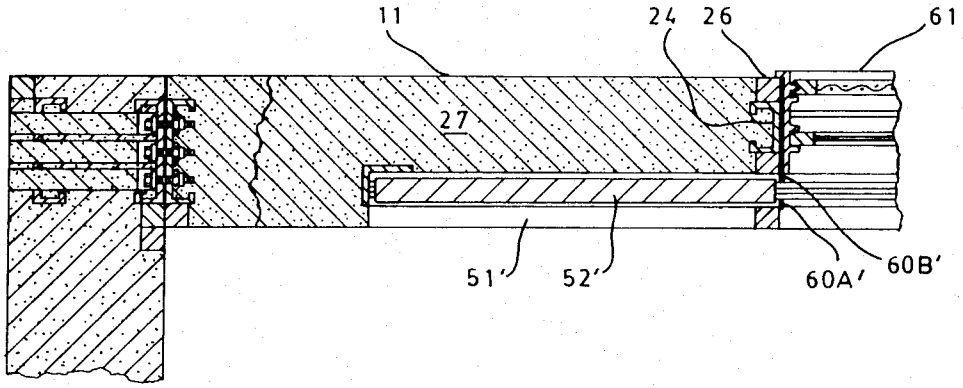
FIGS. 6 and 7 are top views, in section, of portions of sidewall modules of the present invention.

In FIG. 7, the sidewall module 11 is provided with a sliding door 61 (only a portion being shown). As illustrated, the door 61 can also be provided with a sliding insulation panel 52'. The panel 52' functions essentially in the same manner as the window insulation panel 52 and thus commonly functioning features and components are indicated with common prime numerals in FIG. 7.

As illustrated in FIGS. 5 and 8, the ceiling modules 12 comprise a primary frame 62 made up of beams 63, the beams 63 preferrably being fabricated of steel, aluminum, or other durable metal. A secondary frame 64 comprising facing beams 66 secured to either side of the beams 63, and a plurality of ceiling joists 67 are also provided. The secondary frame 64 is filled with foam insulation 27 such that the foam insulation 27 define an upper and lower planar surfaces 68 and 69, respectively, which are flush with the secondary frame 64. As illustrated in FIG. 5, the ceiling modules 12 are secured to sidewall modules 11 by securing the beams 63 of the primary frame 62 to the upper horizontal supports 20 of the sidewall modules 11. Accordingly, a plurality of selectively spaced holes 70 are provided in the beams 63 of the primary frame 62 which register with holes 71 (see FIG. 2) in the upper horizontal supports 20, and fasteners 38 are inserted through the holes 70 and 71 and locked into place as described above with regard to joining the sidewall modules 11. It will be appreciated that access openings 72 are left in the foam 27 of the ceiling modules 12 to allow the insertion of the fasteners 38, and to ensure the continuity of the insulation, the access openings are filled with foam insulating plugs 73 after the fasteners 38 have been locked in place. Further, a suitable gasket (not shown) is provided between the upper horizontal supports 20 and the beams 63 to insure a moisture impervious seal between the ceiling modules 12 and the sidewall modules 11.

Referring once again to FIG. 8, the secondary frame 64 of the ceiling module 12 is also provided with a plurality of selectively spaced holes 74, registering with holes 74 of an adjacent ceiling module 12, such that adjacent ceiling modules 12 can be secured together with suitable fasteners 76. To allow access for the insertion of the fasteners 76, voids 77 are provided in the foam insulation 27, the voids 77 being filled with foam insulation plugs 78 after the fasteners 76 have been secured. Accordingly, as illustrated in FIG. 1, several ceiling modules 12 can be secured together to form the ceiling of the building 10. Of course, suitable gaskets (not shown) are provided between adjoining ceiling modules 12. Further, in one preferred embodiment (see FIG. 9) the ceiling modules 12 are covered on the upper planar surface 68 with a sheet of waterproofing material 79 to ensure that the ceiling is substantially water impervious. Desirably, the waterproofing material 79 comprises a flexible plastic or rubber-like sheet covered on its upper surface with an aluminum foil. An example of a desirable commercially available waterproofing would be the "KMM Membrane" manufactured by Koppers Company Inc. of Pittsburgh, Pa. Also, it will be appreciated that the ceiling modules 12 can be provided on the lower planar surface 69 with a sheet rock or other ceiling finishing material 80 such that when the ceiling modules 12 are secured in place, only the seams between the modules 12 require taping or other finishing.

It will be appreciated that the combination of the waterproofing material 68 and the inherent insulating qualities of the ceiling modules 12 greatly reduce the insulation demands normally placed upon a roof. Therefore, practically any conventional roof configuration is suitable for use with the building 10. By way of example, in FIG. 9 the illustrated embodiment of the building 10 is provided with the roof 13. The roof 13 comprises a conventional rafter configuration with a suitable roofing material 82 fastened to the rafters 81, over only a polyfoam or reinforced plastic foil vapor barrier 83. An example of a suitable roofing material would be the STILE metal roofing tile system manufactured by Metal Sales Manufacturing Corporation, Louisville, Ky. Therefore, the highly effective insulation provided by the ceiling modules 12 obviates the need for conventional plywood roofing over the rafters and between rafter insulation.

The floor modules 14 are also designed such that several modules 14 can be joined to create the floor of the building 10. The size of the floor modules 14 is variable, but a maximum of 40 feet in length and 10 feet in width is desirable such that they may be transported by a conventional tractor and trailer. Accordingly, the number of modules 14 will vary depending on the size of the modules 14 used and the size of the building 10.

Figure 11:
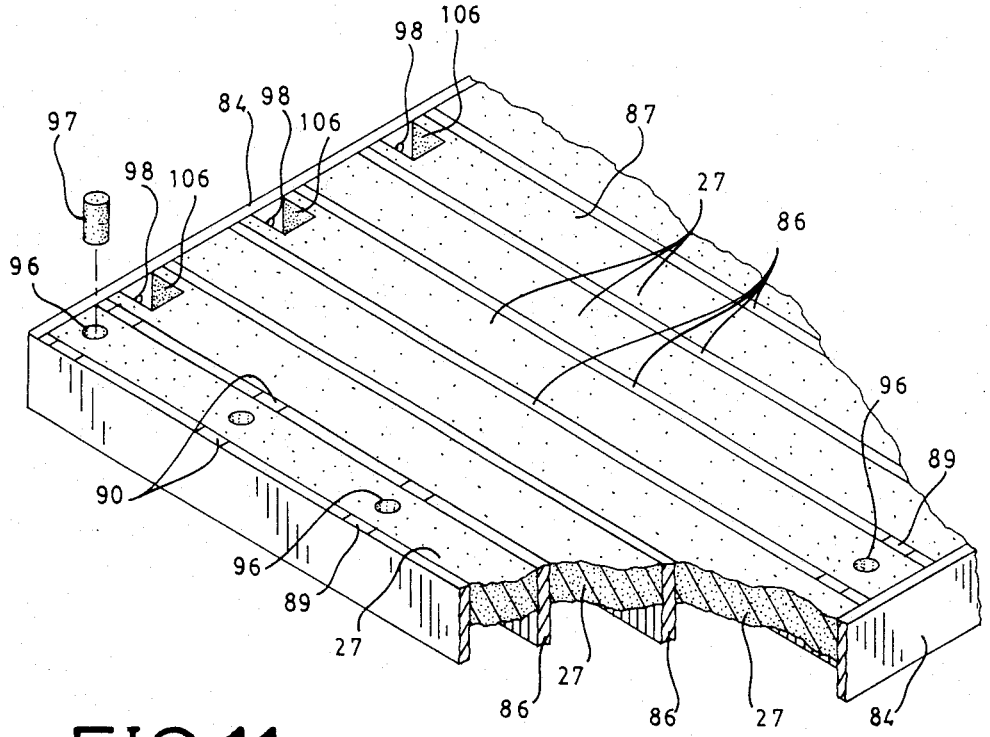
FIG. 11 is a perspective view, partially in section, of a floor module of the present invention.

As illustrated in FIG. 11, the floor modules 14 comprise a perimeter frame 84 supporting a plurality of selectively spaced substantially parallel floor joists 86. The areas between the floor joists 86 and between the floor joists 86 and the frame 84 are filled with rigid foam insulation 27 so as to define an upper floor surface 87 which is flush with the upper edges of the frame 84 and the joists 86. It will be appreciated by those skilled in the art that less insulation is required in the floor modules 14 than in the sidewall modules 11 and the ceiling modules 12 since the modules 14 have less exposure to the weather. Accordingly, in the illustrated embodiment, the floor modules 14 are only partially filled with foam insulation 27. Of course, if desired, more insulation 27 can be provided in climates which experience unusually cold winters.

Figure 10:
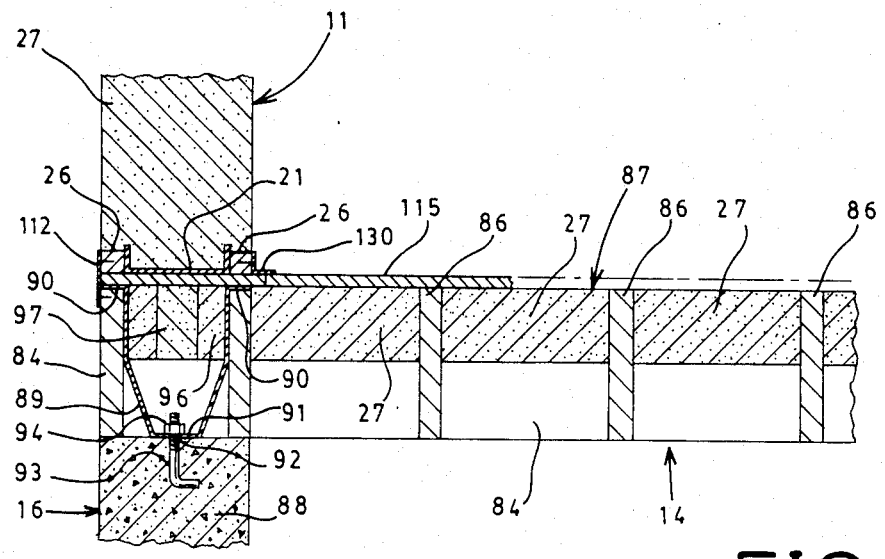
FIG. 10 is a side elevation view, in section, of a portion of a floor module of the present invention.

Referring now to FIG. 10, the floor modules 14 are secured at selected locations to the footers 88 of the foundation 16 with the brackets 89. The brackets 89 are provided with oppositely disposed flanges 90 which are secured with suitable fasteners, e.g., screws, or nails, to the upper edges of the frame 84 and the adjacent joist 86, or to two adjacent joists 86, depending on the location at which the bracket 89 is mounted. The brackets 89 further comprise an engaging end 91 provided with a hole 92 which receives an anchoring bolt 93 which is set in the footer 88. As illustrated, a nut 94 is provided for threadably securing the bolt 93. Of course, an aperture 96 is provided in the foam insulation 27 to allow access to the bolt 93 such that the nut 94 can be secured, after which the aperture 96 is filling with a foam insulation plug 97.

Figure 12:
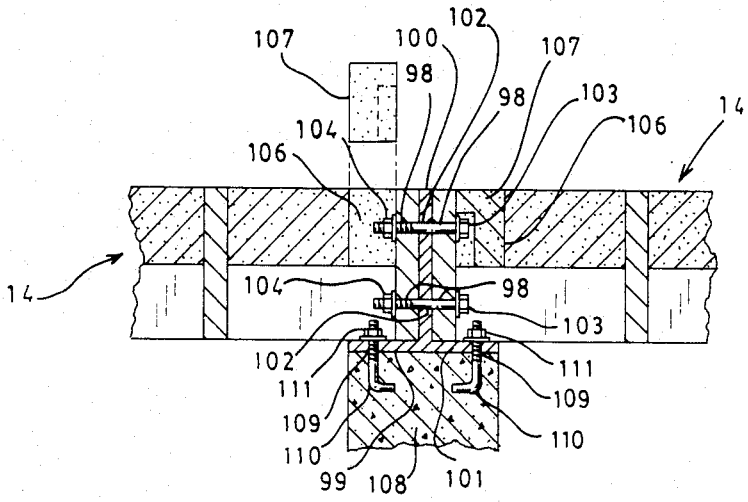
FIG. 12 is an end view, in section, of selected portions of two adjoining floor modules of the present invention.

To facilitate securing adjacent floor modules 14 together, the frame 84 is provided with a plurality of selectively spaced holes 98 registering with the holes 98 of an adjacent floor module 14. As illustrated in FIG. 12, a support member 99, having an inverted T-shaped cross section, defining a vertical portion 100 and a horizontal portion 101, is placed between and extends the length of, the floor modules 14. A plurality of selectively spaced holes 102, registering with the holes 98, are provided in the vertical portion 100, and, as illustrated, the bolts 103 are inserted through the registering holes 98 and 102 and secured with suitable nuts 104. Once again, access voids 106 are left in the insulation 27 to provide access for securing the bolts 103, the voids 106 being subsequently filled with the foam insulation plugs 107. It will be appreciated by those skilled in the art that this is merely one preferred means of securing the adjoining floor modules 14, and other means can be used if desired.

Of course, foundation piers 108 are provided at selected locations to support the floor modules 14 from beneath, and, accordingly, the horizontal portion 101 of the support member 99 carries holes 109 receptive of anchoring bolts 110, the bolts 110 being mounted in the pier 108. Nuts 111 are used to secure the support member 99, and thus the modules 14, to the pier 108.

Figure 13:
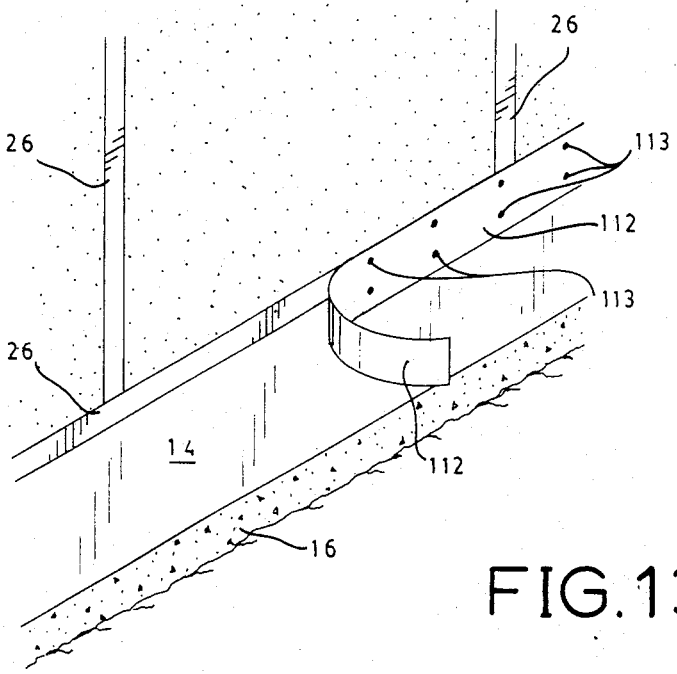
FIG. 13 is a perspective view of one preferred means of securing the sidewall modules to the floor modules of the present invention.

With the floor modules 14 secured together and secured on the foundation 18 and piers 108, the sidewall modules 11 can be placed in position on the floor modules 14. As illustrated in FIG. 13, in one preferred embodiment the sidewall modules 11 are secured to the floor modules 14 with a fastening strip 112. The strip 112 is positioned along the seam between the modules 11 and 14 so as to overlap both modules 11 and 14 and then secured with suitable fasteners 113. It will be appreciated that the fasteners 113 can comprise screws, nails, staples or similar fasteners. Further, as illustrated in FIG. 10, after the subfloor 115 is installed, the sidewall modules 11 can be further secured with L-brackets 130 secured to the furring strips 26 of the module 11 and the subfloor 115 with suitable fasteners. Of course, a gasket (not shown) will be provided between the lower horizontal supports 21 of the sidewall modules 11 and the floor modules 14 to insure a mositure impervious seal. It will also be appreciated that other suitable fastening means can be used for securing the sidewall modules 11 to the floor modules 14, and the illustrated means is merely demonstrative of one suitable means.

As discussed above, and as illustrated in FIG. 5, where the building 10 is constructed on a concrete slab 114, the sidewall modules 11 can be mounted directly on the slab 114. In this regard, the slab 114 is provided with a plurality of anchoring bolts 116 set in the concrete of the slab 114 at selected intervals proximate the perimeter of the slab 114. Cooperatively, the lower horizontal supports 21 of the modules 11 are provided with holes 117 for receiving the bolts 116, with the bolts 116 being threadably secured with the nuts 118. Voids 119 are provided in the insulation 27 of the sidewall module 11 to allow access to the bolts 116 such that the nuts 118 can be threaded thereon. After the nuts 118 are secured, a foam insulation plug 120 is inserted into the void 119 such that a gap in the foam insulation 27 does not remain.

Figure 14A:
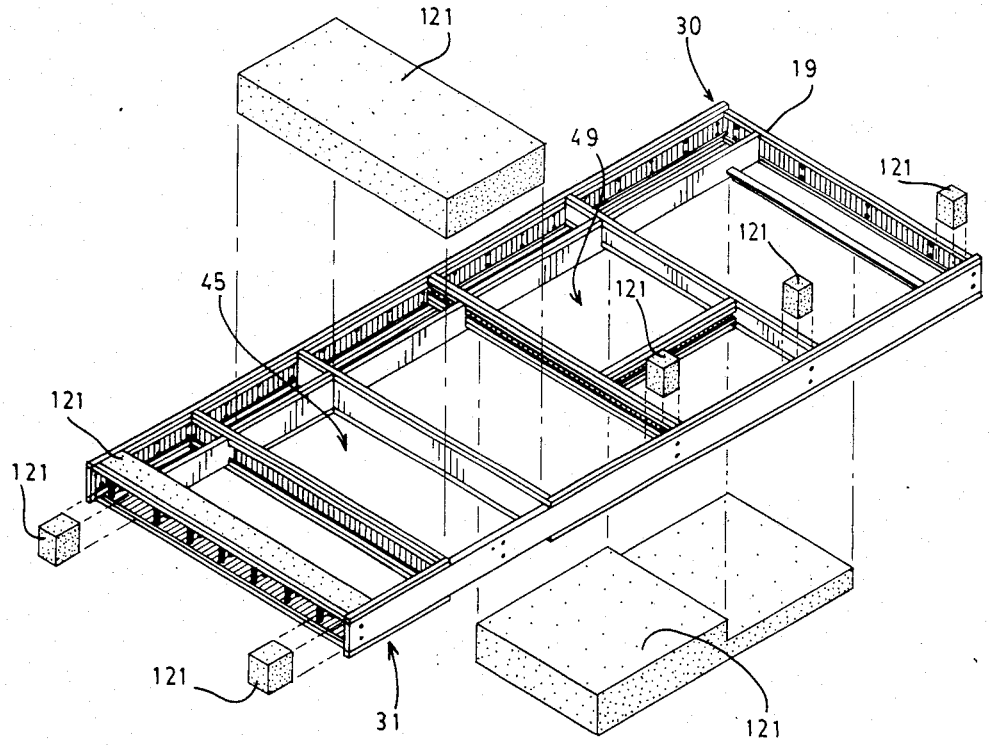
FIGS. 14A, 14B, and 14C are perspective views of the various steps of the fabricating method of the present invention whereby a sidewall module is being fabricated.
Figure 15:
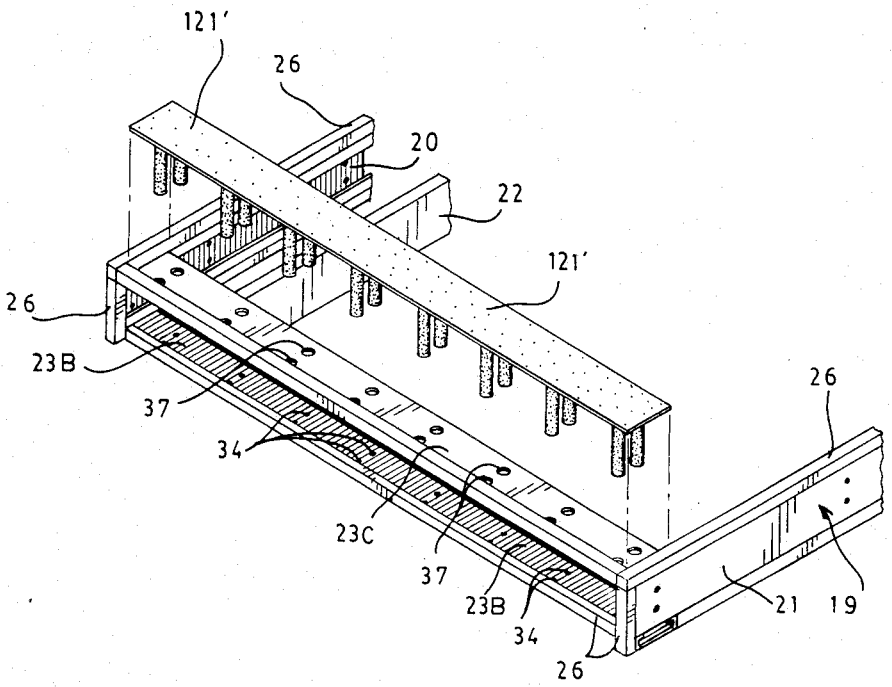
FIG. 15 is a perspective view of a retainer member of the present invention.

As indicated above, the building 10 is designed such that the sidewall modules 11, the ceiling modules 12 and the floor modules 14 are fabricated at a fabricating facility and carried to the building site where they are assembled in accordance with the above discussion. The process by which the modules 11, 12, and 14 are fabricated is essentially an injection mold process. With respect to the sidewall modules 11, the first step is the assembly of the frame 19 as discussed above and as illustrated in FIG. 2. The furring strips 26 are then secured to the frame 19, as is also discussed above. It will be appreciated that various areas in the sidewall modules 11 must be left free of foam insulation 26 such as window openings 49, door openings 45, recesses 51, and access voids 41, 47, etc. Thus, retainer members 121, having external dimensions defining the void to be created, are releasably secured on the frame 19 at the desired locations as illustrated in FIG. 14A. It will be appreciated that during the molding process, the retainer members 121 will maintain these areas free of foam insulation 27. For example, the retainer member 121' is inserted into the holes 37 of support members 23C to facilitate the formation of the conduits 39 as is illustrated in FIG. 15.

Figure 14B:
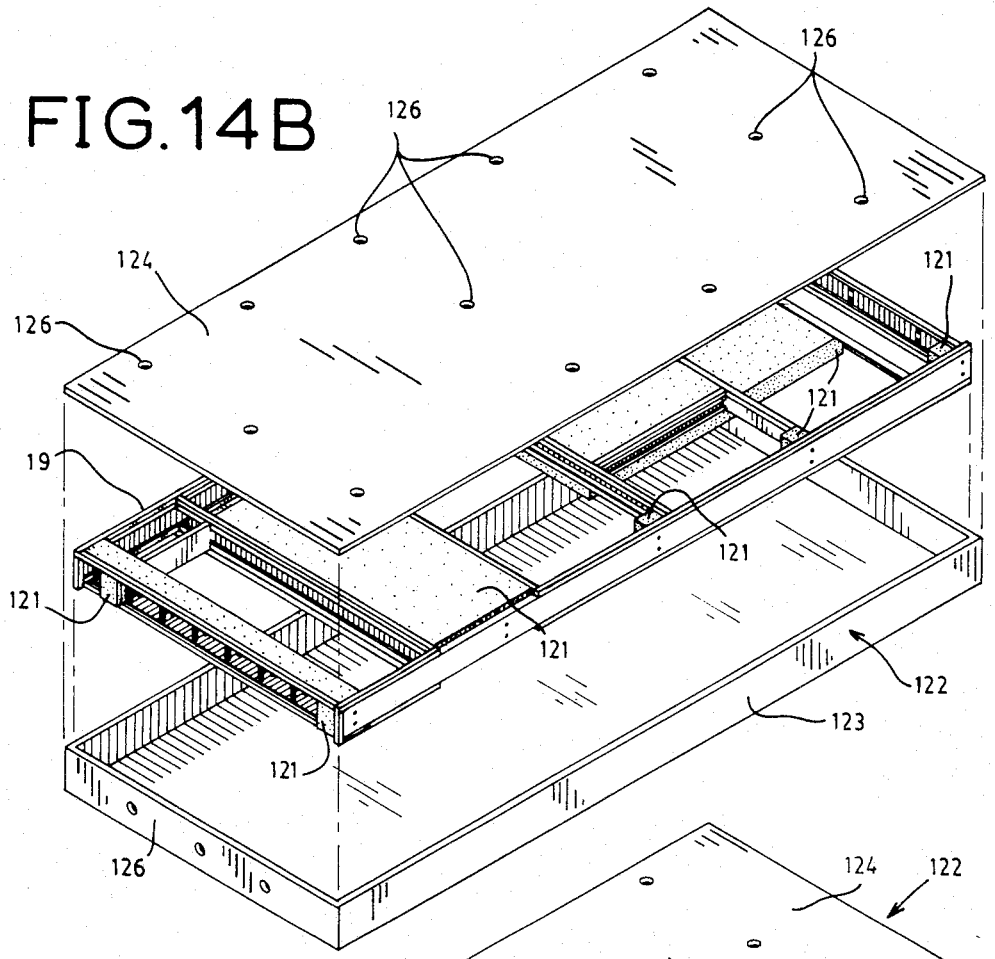
Figure 14C:
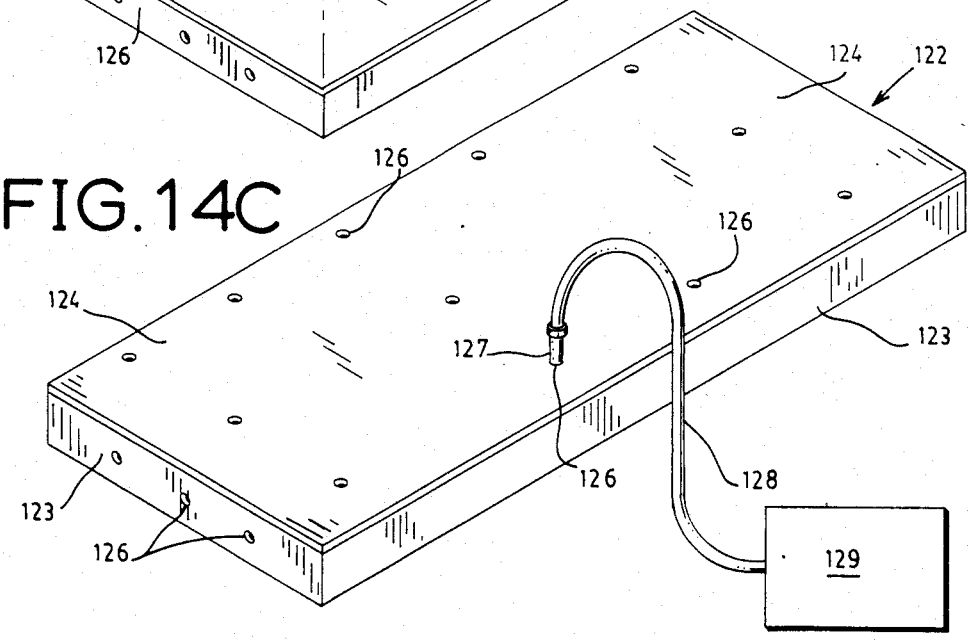

As illustrated in FIGS. 14B and 14C, the mold 122 comprises an enclosure 123 having a top panel 124, and when the retainer members 121 are in place, the frame 19 is placed in the enclosure 123 and the top panel 124 is secured in place enclosing the frame 19 within the mold 122. It will be appreciated that the interior dimensions of the mold 122 correspond to the desired exterior dimensions of the sidewall module 11 to be formed. Further, it should be noted at this point that a plastic liner (not shown) can be releasably inserted into the mold 122 prior to insertion of the frame 19 to line the mold 122 such that the insulation 27 does not stick to the interior walls of the mold 122. As illustrated, the mold 122 is provided with a plurality of injection ports 126 communicating with the interior of the enclosure 123. The injection ports 126 are selectively positioned proximate areas to be filled with insulation 27. As illustrated in FIG. 14C, a foam injection nozzle 127 secured to the end of a foam supply hose 128 is successively secured to the various ports 126 and liquid foam insulation 27 is supplied under pressure from a suitable foam insulation supply source 129 and injected into the mold 122.

When the mold 122 has been filled with foam insulation 27 and after the foam 27 has been given time to solidify, the molded sidewall module 11 is removed from the mold 122 and the various retainer members 121 are removed from the module 11. It will be noted that the portion of the lower horizontal support 21 which extends across the door opening 45 is left in place (see FIG. 1) until after the module 11 has been transported to the building site, whereupon it is cut away such that a suitable door unit can be installed. This portion of the lower horizontal support 21 is left in place to ensure that the modules 11 are structurally sound enough to be transported without damage to the modules 11.

It will be appreciated that the ceiling and floor modules 12 and 14, respectively, are fabricated using the same method. With regard to the ceiling modules 12, the primary and secondary frame 62 and 64, respectively, and the attached ceiling joists 67, provided with the desired retainer members 121, are placed in a mold 122 and foam is injected. And, with regard to the floor modules 14, the frame 84, with the attached floor joists 86 and retainer members 121, is placed in a mold 122 and foam insulation 27 is injected.

In light of the above, it will be appreciated that a building 10 is provided which requires very little on-site construction time. Once the floor modules 14, the sidewall modules 11, the ceiling modules 12, and roof 13 are appropriately joined, the main structural components of the building are provided and only finishing tasks such as securing exterior siding and dry wall or interior paneling remain. Of course, if desired, much of the interior dry wall can be secured at the fabricating facility, leaving only the taping of joints to be done. Further, the modules 11, 12, and 14 join to provide a highly insulated energy efficient structure, and the process by which the modules 11, 12, and 14 are fabricated, and the relatively limited labor necessary for assembling the building 10, allows the building 10 to be erected at a substantially reduced cost relative to conventional construction methods.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. An improved modular building for being erected on a foundation at a preselected building site, said building comprising:

a plurality of sidewall modules each said sidewall module comprising a primary frame and a secondary frame of furring strips, said secondary frame being secured to said primary frame with suitable fasteners, each said sidewall module further comprising foam insulation formed within interstices of said primary and secondary frame and defining exterior and interior sidewall surfaces, each said sidewall module having opposite end portions for engaging an adjacent sidewall module;

a ceiling supported by and secured to said sidewall modules;

wherein said sidewall modules define at least one window opening for mounting a window, said sidewall module being provided with a window panel recess adjacent said window opening and further provided with a window insulation panel slidably mounted in said window opening and said recess whereby said window insulation panel can be slidably moved between a first position whereby said panel covers and insulates said window and a second position whereby said panel is received in said recess in said sidewall module; and wherein said sidewall modules further define at least one door opening for mounting a door, said sidewall module being provided with at least one door panel recess adjacent said door opening and further provided with a door insulation panel slidably mounted in said door opening and said recess whereby said door insulation panel can be slidably moved between a first position whereby said door insulation panel covers said door opening for insulating said door opening and a second position whereby said door insulation panel is received in said door panel recess in said sidewall module.

2. The improved modular building of claim 1 wherein said primary frame of said sidewall modules comprises upper and lower horizontal supports extending substantially the length of said sidewall modules and further comprising at least one vertical support proximate each said opposite end portion of said sidewall modules, each said vertical support having an upper end portion secured to said upper horizontal support member and a lower end portion secured to said lower horizontal support and wherein said vertical supports of each said sidewall module are provided with holes and said means for engaging an adjacent sidewall module comprise suitable fasteners received in said holes in said vertical support and said holes of said vertical support of said adjacent sidewall module and locked in place.

3. The improved modular building of claim 2 wherein said primary frame further comprises a lintel beam having opposite end portions secured to said vertical supports proximate said opposite end portions of said sidewall modules said lintel beams being provided with a cover member extending substantially the length of said lintel beam whereby said cover member and said lintel beam define a wiring passageway which extends substantially the length of said sidewall modules, and wherein said vertical supports are provided with openings communicating with said wiring passageway for accessing said passageway.

4. The improved building of Claim 1 wherein said foundation is provided with a plurality of selectively spaced anchor bolts, and wherein said sidewall modules are provided with means for engaging said foundation which comprises a plurality of bracket members secured to said sidewall modules, said bracket members being provided with a hole receptive of said anchor bolts and further provided with a plurality of nuts for threadably securing said brackets to said anchor bolts.

5. An improved prefabricated sidewall panel for the construction of an energy efficient modular building, said panel defining a perimeter and first and further substantially planar surfaces spaced apart a first selected distance, said panel comprising:

a primary frame fabricated of members to define said panel perimeter and further define first and further substantially planar surfaces spaced apart a distance less than said first selected distance, said primary frame fabricated of a top member, a bottom member, a pair of vertical support members each joined at their extremities to said top and bottom members, and a lintel member substantially parallel to said top member and attached to said support members;

a secondary frame of furring strips attached to said primary frame at selected locations with suitable fasteners, said secondary frame defining said first and further planar surfaces of said panel;

foam insulation formed in place throughout interstices of said primary and secondary frames of said panel to further define said first and further planar surfaces of said panel;

wherein said panel is provided with at least one window opening therethrough for mounting a window, said window opening defined by said lintel member and by selected of said furring members of said secondary frame, and with a window panel recess adjacent said window opening; and said sidewall panel further comprises a window panel of thermal insulating properties slidably mounted in said window panel recess whereby said window panel is slidably movable between a first position covering said window and a second position within said window panel recess.

6. The panel of Claim 5 wherein said lintel member is provided with a cover member extending substantially the length of said lintel member to define, with said lintel member, a wiring passageway extending substantially the length of said panel, and wherein said vertical support members are provided with openings communicating with said wiring passageways.

7. An improved prefabricated sidewall panel for the construction of an energy efficient modular building, said panel defining a perimeter and first and further substantially planar surfaces spaced apart a first selected distance, said panel comprising:

a primary frame fabricated of members to define said panel perimeter and further define first and further substantially planar surfaces spaced apart a distance less than said first selected distance, said primary frame fabricated of a top member, a bottom member, a pair of vertical support members each joined at their extremities to said top and bottom members, and a lintel member substantially parallel to said top member and attached to said support members;

a secondary frame of furring strips attached to said primary frame at selected locations with suitable fasteners, said secondary frame defining said first and further planar surfaces of said panel;

foam insulation formed in place throughout interstices of said primary and secondary frames of said panel to further define said first and further planar surfaces of said panel;

wherein said sidewall panel is provided with at least one door opening therethrough for mounting a door, said door opening defined by said lintel member and by selected of said furring members, and with a door panel recess adjacent said door opening; and said sidewall panel further comprises a door panel of thermal insulating properties slidably mounted in said door panel recess whereby said door panel is slidably movable between a first position covering said door and a second position within said door panel recess.

* * * * *